United States Patent [19]

Bowles et al.

[11] 4,245,918

[45] Jan. 20, 1981

[54] ERASE THROUGH TAB

[75] Inventors: David J. Bowles, Winchester, Ky.; Douglas E. Clancy, Austin, Tex.; Carl F. Johnson, Lexington, Ky.; Danny M. Neal, Austin, Tex.

[73] Assignee: International Business Machines Corporation, Armonk, N.Y.

[21] Appl. No.: 908,315

[22] Filed: May 22, 1978

[51] Int. Cl.[3] ..... B41J 33/14; B41J 25/18

[52] U.S. Cl. ..... 400/697.1; 400/279; 400/307.2; 400/310

[58] Field of Search ..... 400/76, 279, 280, 290, 400/306, 309, 696, 697, 697.1, 695, 307.2, 310

[56] References Cited

U.S. PATENT DOCUMENTS

| | | | |
|---|---|---|---|
| 3,630,336 | 12/1971 | Johnson et al. | 400/306 X |
| 3,780,846 | 12/1973 | Kolpek et al. | 400/697.1 X |

OTHER PUBLICATIONS

IBM Technical Disclosure Bulletin, "Electronic Tab/-Backspace Control", Fulbright et al., vol. 13, No. 10, Mar. 1971, pp. 3182–3184.

*Primary Examiner*—Ernest T. Wright, Jr.
*Attorney, Agent, or Firm*—Laurence R. Letson

[57] ABSTRACT

An electronic typewriter which has the capability of erasing characters automatically and which has the further improved capability of being able to back through unused space on the line, which results after a tabulation command, thereby allowing the repositioning of the type element over the characters typed prior to the tab command thereby allowing automatic erasure of those characters. The improvement of the typewriter as described permits the retrieving of characters from an electronic memory and the use of that memory to control the erase cycle even where the carrier position and the character to be erased are on opposite sides of space without printed characters due to a tab command. This is accomplished by the electronic control of the mechanical hardware and the ability to determine where the tab command was entered on the typing line and to prevent erasure cycles in the unprinted space until the carrier has returned to the point at which the tabulation command was entered.

5 Claims, 7 Drawing Figures

ERASE THROUGH TAB

BACKGROUND OF THE INVENTION

There exists in the market place today typewriters which permit the erasure or correction of characters by the mere depression of the error correction key. These typewriters and printers have associated with them electronic controls and a memory. As the error correction key is depressed the memory is read to determine which character was previously printed and the typewriter is conditioned to cause correction of that character. In typewriters presently available which have this capability, the memory is read in reverse order. Where a tabulation command is entered there is no way for the electronics to recognize this and therefore if correction is attempted it is possible that the printer will attempt to correct a letter where no letter exists, particularly between the point where the tabulation command was initiated and the point representing the tab stop. Thus the characters cannot be automatically corrected where they are positioned before a tab stop where a tab command was utilized to position the carrier at that tab stop.

In view of this the automatic correction sequence and performance of the typewriter is diminished from that which is desirable and necessitates an alternate correction technique in order to cause the correction to be accomplished properly.

It is the object of this invention to correct errors on a typewritten page automatically where the errors are located previous to a location where a tab command was entered on the keyboard.

Another object of this invention is to correct typewritten errors on the same writing line regardless of the location of the errors on the writing line.

It is still another object of this invention to ease the operator's burden in correcting errors in typewritten copy.

SUMMARY OF THE INVENTION

In order to accomplish the correction of information on a typing line in the typewriter where an error has been made and where a tab code has been inserted after the error, it is necessary to reposition the print carrier over the incorrectly typed characters. When an electronic memory is included into the typewriter for its operation and control, it is also advantageous to utilize an automatic erasing arrangement similar to that disclosed in U.S. Pat. No. 3,780,846 to Robert A. Kolpek, et al, commonly assigned herewith. In such a scheme, as the erase control key is depressed, the carrier of the printer is backspaced and the memory of the printer controls are interrogated to determine the previously printed character. This data determined from the memory together with the erase command, conditions the printer in an erase mode to place the correction media between the typing element and the printed page and conditions the printer to perform a print operation using the previously typed character. This accomplishes erase as is well known in such products as the IBM Memory Typrwriter.

The improvement, over this technique, which is the subject of this disclosure, permits the erasure or correction of errors preceding a tabulation command. When a tabulation command is entered into the controls of the typewriter by the depression of the appropriate keyboard key, the location of the print carrier or print point with respect to its left most possible limit of travel, which is maintained by the escapement logic, is stored into the line memory of the electronic printer controls thus recording the position of the print point at the time that a tabulation command is initiated. Following the storage of this tabulation start location code in the line memory of the electronic print controls, there is inserted a special tabulation function or flag code which may be read in the reverse direction as the carrier is subsequently backed up by the backspace commands and thus controls the escapement logic of the typewriter to cause a comparison between the print point location of the carrier and the point at which the tabulation command was generated.

During the correction cycle, the escapement logic through the escapement counter causes the magnet drivers to effect a backspace of a standard width, and if the distance between these two locations exceeds one backspace increment, the cycle is repeated for every correction cycle command received from the typewriter keyboard.

Upon the determination that the location at which the tab command was received from the keyboard and the print point is separated by a distance less than or equal to one standard backspace escapement increment, the typewriter is then commanded through the escapement logic to reverse tabulate the number of escapement increments necessary to reposition the print point directly over the location on the print line at which the tabulation command was generated. A subsequent depression of the correction key creating a correction command will then cause the line memory to be interrogated and the appropriate alphanumeric or space code read and the printer commanded to effect an erase operation as described above.

A more complete understanding of the invention will be had from a reading of the detailed description to follow.

Figure 1:
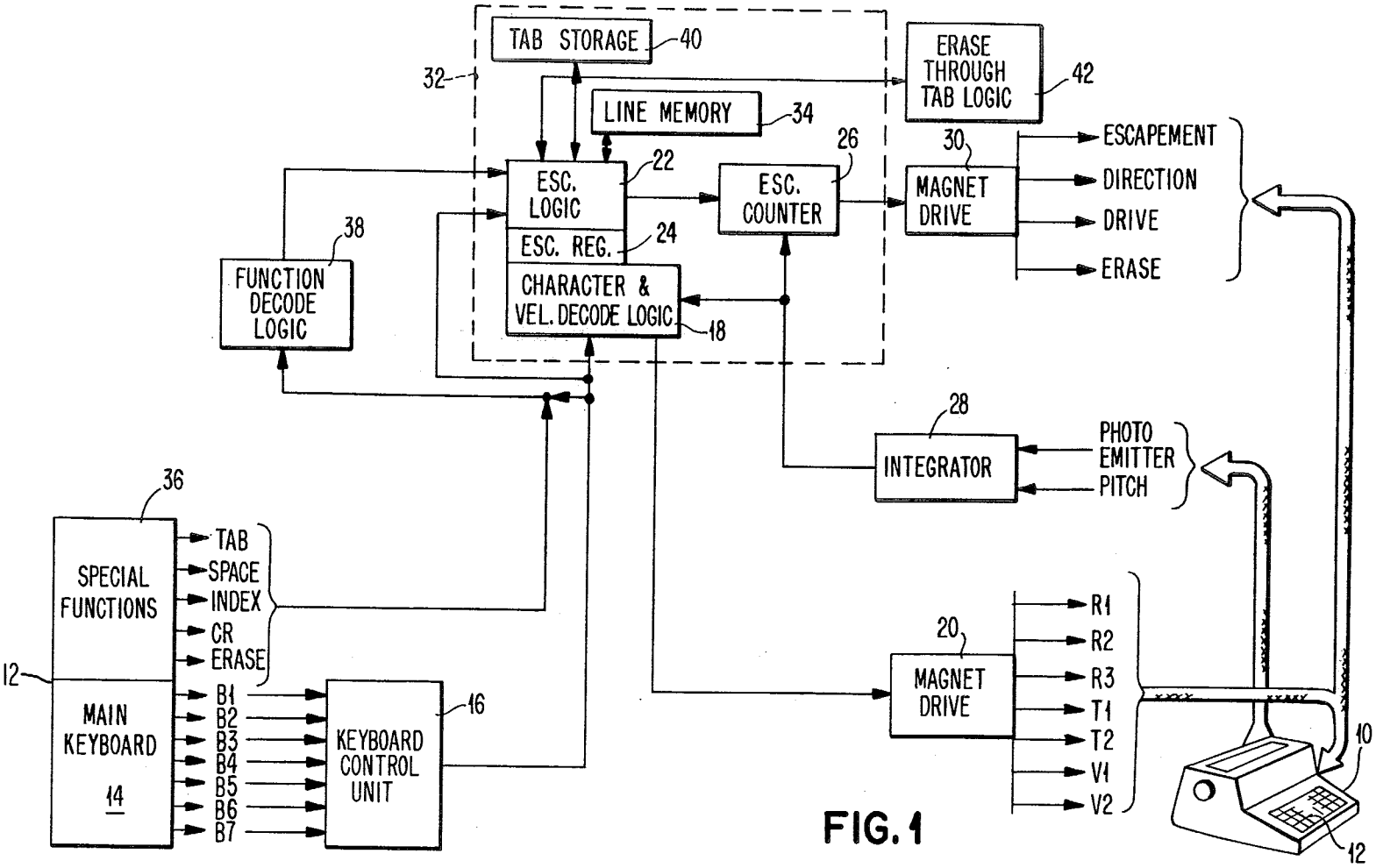
FIG. 1 is a block diagram of the electronics for performing the functions of the typewriter feature.
Figure 2:
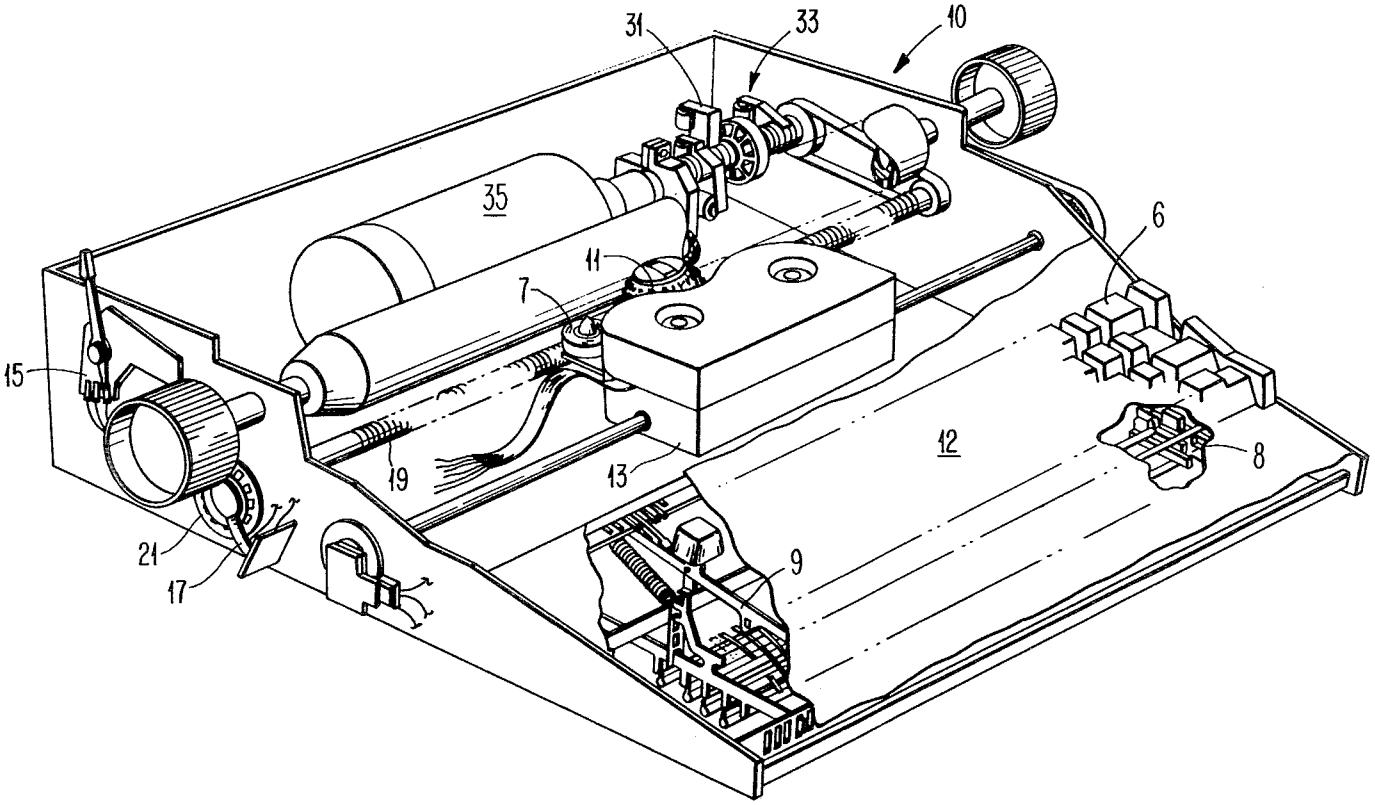
FIG. 2 is a partial view of the typewriter.

Referring to FIG. 1, there is illustrated a typewriter 10 which is controlled by electronics in that the keyboard signals generated are processed electronically and the electronic controls therein then issue electronic commands to the printer to effect the appropriate functions of the printer elements to cause printing, escaping, backspacing, tabulation, correction and other normal printer functions. When a key lever 9 on the keyboard 12 is depressed to effect the selection of a character for printing, the keyboard 12 causes the switches 8 to make in a predetermined pattern thereby transmitting signals from the main keyboard 14, which is a block depiction of the switches 8, to the keyboard control unit 16. The keyboard control unit 16 captures the electronic inputs from the bail codes B1 through B7 and generates an appropriate strobe or control signal which then causes the total data signals to be transmitted to the character and velocity decode logic 18. The character and velocity decode logic 18 then converts the signals from the keyboard control unit 16 into signals which represent the position of the type element 11 of the character selected by the key lever depression. This is accomplished by converting the keyboard control unit 16 signal into signals to magnet drivers 20 which then effect the rotation and the tilt of a single type element 11 or other conventional selection technique, to position the type font desired at the print point and then the selection of other controls such as the velocity with which that type font is propelled toward the printed page. The signals output by the magnet drivers 20 are represented by R1, R2 and R3 for rotation, and T1, T2 for tilt of the typehead and V1 and V2 for print velocities. These signals control magnets (not shown) in the typewriter 10.

The keyboard control unit 16 signals are simultaneously read into the escapement logic 22 which, then, through a conventional table look-up determines the assigned escapement values for each of the characters which are represented by the output of the keyboard control unit 16. These escapement values or widths may be a standard width such as for example using a 1/60th of an inch per unit, 6 units for a 10 pitch escapement or 5 units for a 12 pitch escapement. Additionally with the escapement of characters being defined as units of 1/60th of an inch, it is possible to assign escapement values to characters proportional to their actual printing width, otherwise known as proportionally spaced characters. This thereby provides the capability of escaping the typewriter 10 responsive to the keyboard control signals and effecting proportionally spaced character printing.

The position of the carrier 13 or the print point defining means of the typewriter 10 is constantly stored in the escapement register 24 which is a portion of the escapement logic 22, thereby providing a current location, measured from the left most point of travel of the print carrier 13, and this value is updated as the print carrier 13 translates left or right under the control of any of the keyboard signals. The escapement logic 22 outputs the width of the characters which have been selected at the keyboard 12 to the escapement counter 26. This is necessary to provide a control over the escapement functions of the printer. The escapement counter 26 then stores on a temporary basis the information necessary to control the translation of the print carrier 13 over a predetermined or preselected distance. The escapement counter 26 is controlled in its operation by the signals emanating from the integrator 28 which has input signals representing the output of the pitch selection switch 15 and the photoemitter/sensor 17 associated with the lead screw 19 and the escapement signal or emitter wheel 21 which indicates which portion of a rotation the lead screw 19 has been rotated through. The pulses created by the photoemitter/sensor 17 and wheel 21 on the end of the rotatable lead screw 19 of the typewriter 10 effect the decrementing of the escapement counter 26. As long as the escapement counter 26 contains a numerical value, the photoemitter/sensor 17 will then pulse the escapement counter 26, through the integrator 28, and cause the escapement counter 26 to provide an output signal to the appropriate magnet drivers 30 to cause movement of the print carrier 13.

The escapement or movement of the print carrier 13 is a result of signals emanating from the magnet drivers 30 which are provided their input from the escapement counter 26. The escapement signal, the direction signal, the drive signal and the erase signal all emanate from the magnet drivers 30 which are controlled ultimately from the main keyboard 14. The escapement magnet driver 30 causes the release of the lead screw 19 and thus allows its rotation together with the emitter wheel 21 which interacts with the photoemitter/sensor 17 thus creating the signals discussed above. The direction magnet driver 30 controls the engagement of the clutches 31 in the drive unit 33 to determine the forward or reverse direction of the carrier 13, by controlling the rotational direction of the lead screw 19. The drive magnet driver 30 provides the engagement or the coupling between the main drive motor 35 of the typewriter 10 and the lead screw 19, through the power transmission or drive unit 33.

The erase magnet driver 30 controls the elevation, from its withdrawn position, of the erase tape 7 so that any subsequent printing effected by the type element 11 causes the impacting of the erase tape 7 against the page to effect erasure, if the character being impacted was the same character as was previously impacted onto the printing ribbon at that print point.

The printer control unit 32 contains the character and velocity decode logic 18, the escapement logic 22, the escapement register 24 and the escapement counter 26 and the line memory 34. As signals are decoded by the character and velocity decode logic 18 for subsequent utilization by the magnet drivers 20 for selection, that same information is temporarily stored in a memory designated as the line memory 34. This line memory 34 is capable of receiving the storage data in the sequence in which it has been received. The line memory 34 is capable of being read in reverse to determine characters which have been previously printed and machine functions which have occurred during that particular line of operation, such as the initiation of a tabulation or space command.

Functions of the typewriter 10 are controlled by the function portion 36 of the keyboard 12. The functions which may be included into such a typewriter 10 include tabulation, space, carrier return, shift and index. Of particular interest in this case is the tabulation function. The tabulation command is sent from the special function portion 36 of keyboard 12 as a series of electronic signals emanating from the switches 8 contained in the keyboard 12 to the function decode logic 38. The function decode logic 38 determines which signal has been received and then passes the output from the function decode logic 38 into the escapement logic 22. The escapement logic 22 receives the decoded function signals and determines whether any escapement function is involved. In the case of tabulation, the escapement logic 22 determines that there is an escapement function involved and also determines that it is necessary to insert into the line memory 34 the tabulation start location code representing the location of the print point at the time that the tabulation function was initiated. This location is the value stored in the escapement register 24 and which represents the displacement of the carrier 13 from its left most position in the typewriter 10. The escapement logic 22, also upon the receipt of the signals from the function decode logic 38, determines that it is necessary to also store in the line memory 34 a special tabulation function or flag code which may be read from the line memory 34 at a later time. The escapement logic 22, under the control of the function decode logic 38 also interrogates the tab storage register 40 to determine the next tab stop position value to the right of the existing print point. This value is then gated into the escapement logic 22 and the value in the escapement register 24, the existing print point, is subtracted therefrom and the difference, representing the distance to be travelled during the escapement operation, is stored in the escapement counter 26. The escapement counter 26, as a result of the value being inserted therein, initiates an escapement function in the forward direction by causing the escapement magnet driver 30, the forward direction magnet driver 30 and the drive magnet driver 30 to be actuated to effect rightward movement of the carrier 13.

Upon the initiation of an erase command from the special function portion 36 of the keyboard 12, the signal generated by the erase key 6 is passed through the function decode logic 38 and decoded. The output of the function decode logic 38 is then gated into the escapement logic 22 which in turn recognizes that the function is an erase operation. The escapement logic 22 accesses the line memory 34 to determine the character which was previously printed in the next left most character position from that of the present print point. If the line memory 34 has a code stored in that position which is designated as a special tab function or flag code, this causes the escapement logic 22 to access the next preceding storage position of the line memory 34 thereby pulling from the line memory 34 the tabulation start location code which has been stored therein. This stored code represents the value of the escapement register 24 at the time of the entry of the initial tabulation command. Under the control of the erase through tab logic 42 and in conjunction with the escapement logic 22, the tabulation start location code stored in the line memory 34 is compared with the value stored in the escapement register 24. If the two location values differ by more that one standard backspace increment, 6 units for 10 pitch, 5 units for 12 pitch, and 4 units for the proportional space mode, the escapement logic 22 then stores the number of units representing a standard backspace increment in the escapement counter 26, and thus activates the magnet drivers 30 to effect reverse direction escapement and drive. As the reverse escapement and backspace is effected by the typewriter 10 the lead screw 19 will rotate and the photoemitter/sensor 17/21 through the integrator 28, will provide a series of pulses to the escapement counter 26 thus decrementing the escapement counter 26 to zero and stopping escapement in the reverse direction. The escapement register 24 represents the position that the carrier 13 occupies, at the end of the backspace operation. If the erase key 6 is either depressed again or is held depressed from the preceding cycle, the entire cycle is repeated and is continued to be repeated until either the erase key 6 is released or the delta distance between the value in the escapement register 24 and the location which has been retrieved from the line memory 34 is lesss than or equal to the standard backspace increment for that particular pitch selection.

When the delta distance between the location stored in line memory 34 and the location value in the escapement register 24 is less than or equal to one standard backspace increment for the selected pitch, then the delta distance between the two positions is stored in the escapement counter 26 and under the contriol of the erase through tab logic 42 in conjunction with the escapement logic 22, the escapement, direction, and driver magnets 30 are all activated thus causing a reverse escapement for the delta distance. This can be also referred to or characterized as a reverse tabulation function.

Upon the repositioning of the print carrier 13 to the tab start location stored in the line memory 34, which is the position at which the original tab command was initiated, a further depression of the erase key 6 will cause the erase through tab logic 42 to control the escapement logic 22 to cause a further backspace of the carrier 13 to position the print point over the next preceding character on the printed page. This is done by accessing line memory 34 to determine the character stored therein and that information is provided to the escapement logic 22 thereby determining the number of escapement increments to reverse escape for such repositioning and at the same time that information is also transmitted through the character and velocity decode logic 18 so that the appropriate character may be selected on the type element 11 and impacted onto the printed page, through the erase tape 7, thus effecting an erasure.

The erase or correction tape or media 7 is controlled by the erase magnet driver 30 under the influence of the outputs from the escapement counter 26.

The controls necessary to control the typewriter 10 which have been explained above in block diagram form are preferably embodied in operational sequences of the electronic logic and devices which may be represented by the flow charts in FIGS. 3 through 6. To more fully understand the operational sequences and the logic controls which are a part of the block diagram illustrated in FIG. 1, further reference is made to FIGS. 3 through 6.

Figure 3:
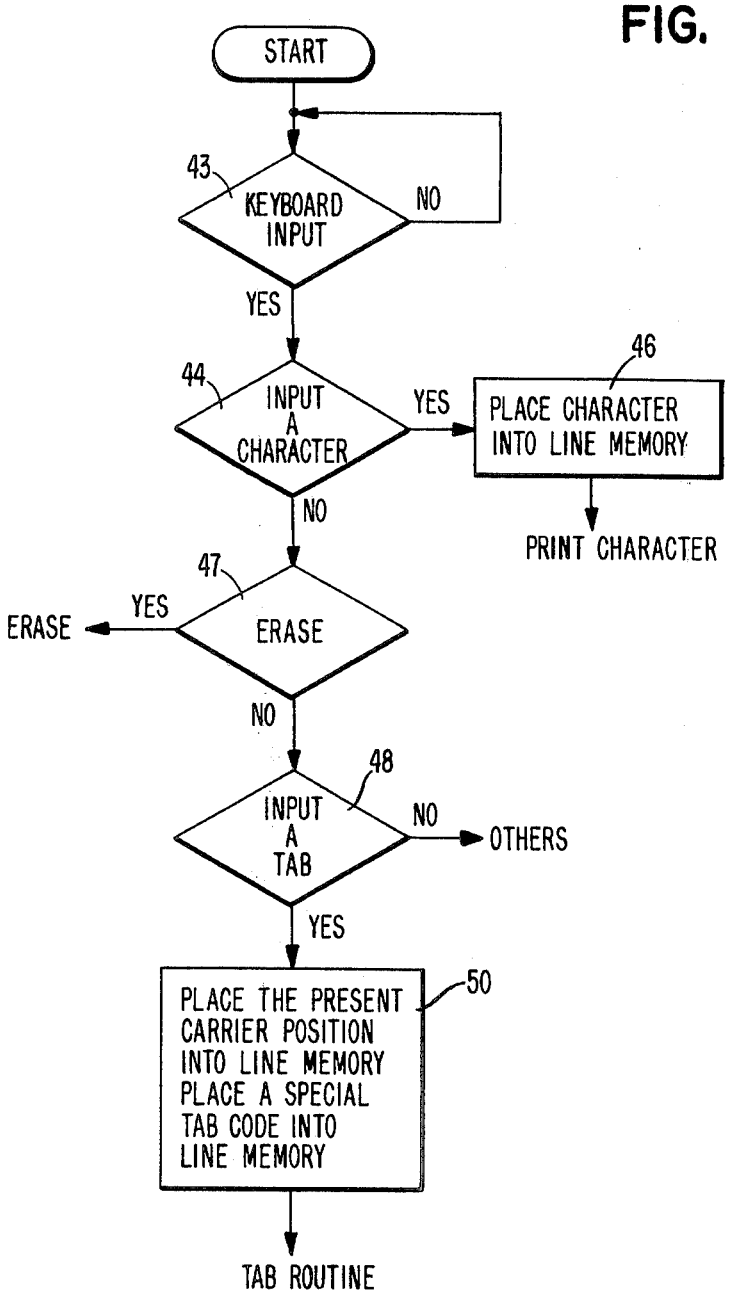
FIGS. 3 through 6 are logic flow diagrams of the logic operations performed by the electronics of FIG. 1.

During normal typing operations, it is necessary from time to time to effect tabulation thereby saving a considerable amount of time over that of repeated spacing operations. Referring to FIGS. 1 and 3 and the start point therein, it is assumed that the typing is in progress. The logic causes a query as to whether a keyboard input has been received and if not loops back to start, repeatedly as illustrated at 43. The character and velocity decode logic 18 of the printer control unit 32 makes a decision 44 as to whether a character has been keyed on the keyboard 12. If the determination is "yes" the character code is stored in line memory 34 in step 46 and the character and velocity decode logic 18 effect the appropriate rotate, tilt and velocity selection and escapement controls to cause the character to be printed. If no character was received 44, then the printer control unit 32 determines whether an erase signal has been received 47, and branches to the erase routine if so. If not the flow is to block 48 where printer control unit 32 then determines whether a tab signal has been received. If no tab signal is received, then the flow branches to other unrelated routines. If there is a tab signal being received 50 by the printer control unit 32, the escapement logic 22 under the control of the erase through tab logic 42 then stores the value in the escapement register 24 in the line memory 34, as the tabulation start location code. After the storage of the value in the escapement register 24 in the line memory 34, a special tab or flag code generated by the erase through tab logic 42 and passed through the escapement logic 22 is then stored sequentially into the line memory 34. At this point, the flow of the control signals branches to a routine which then controls the tabulation of the typewriter 10 under the control of the escapement logic 22. This tabulation routine is substantially identical to that of the escapement routine, in FIG. 6 with the exception that the distances involved are generally greater for tabulation.

Figure 4:
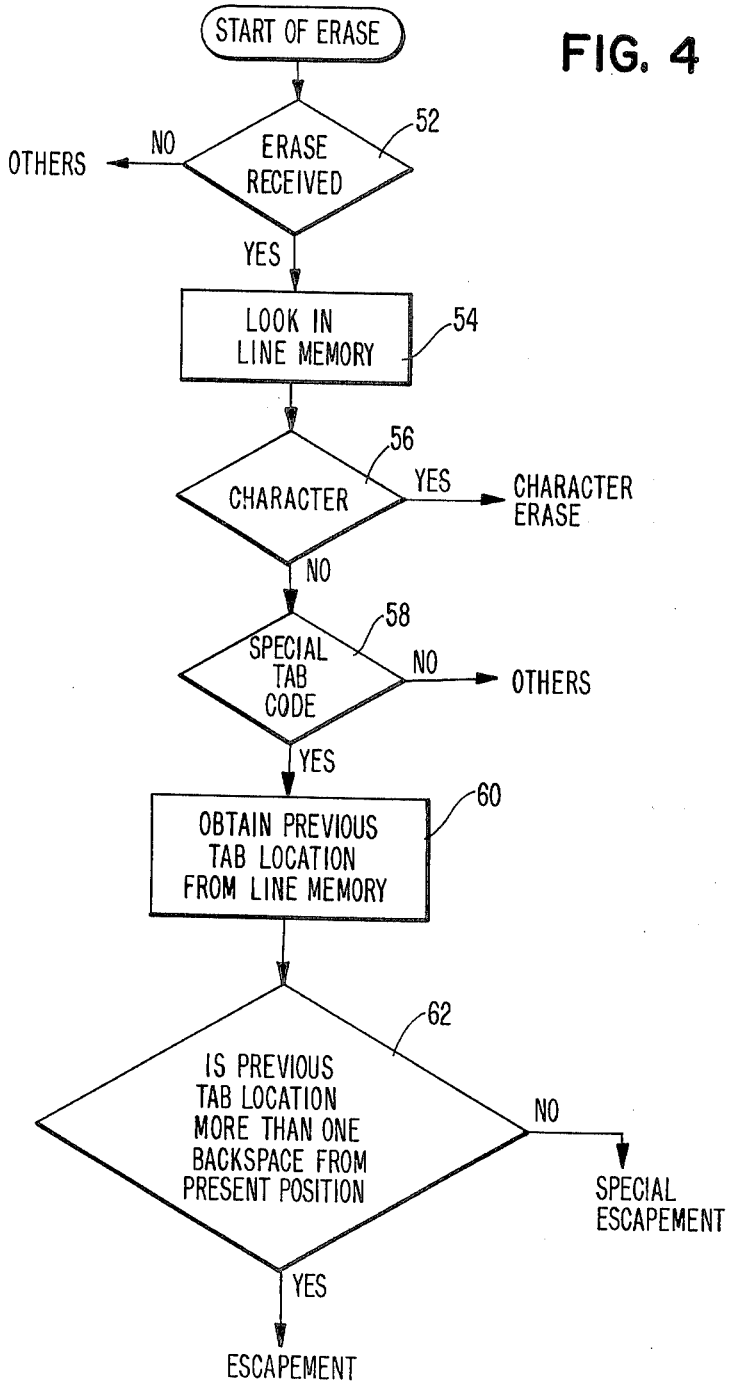
Figure 5:
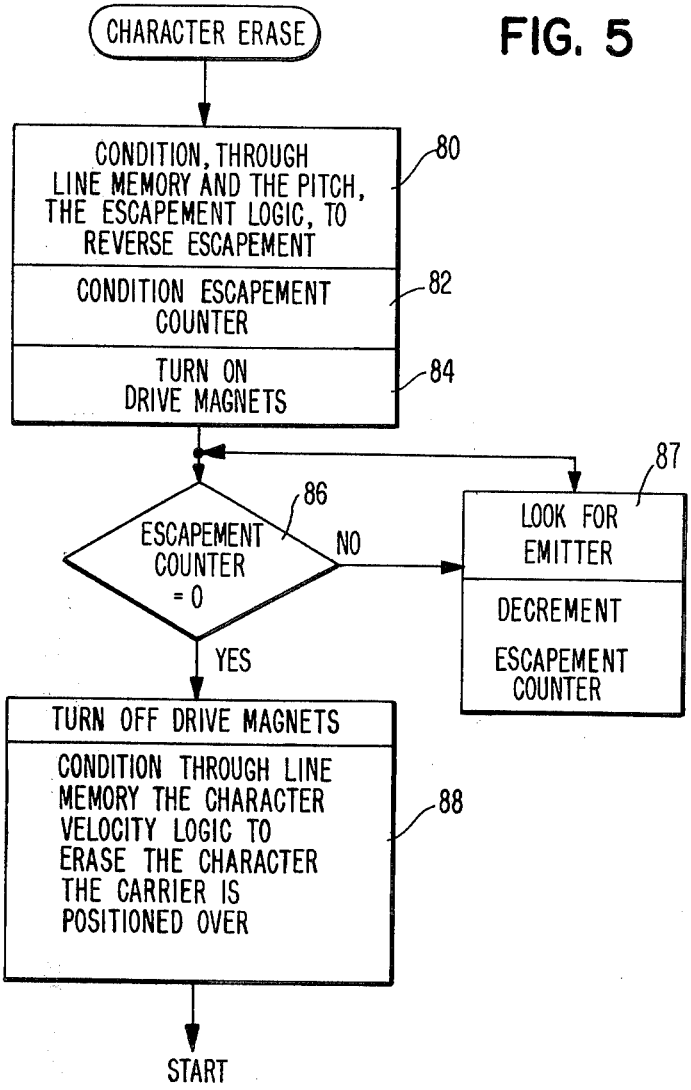

Referring to FIG. 4, the main flow for the logic contained in the erase through tab logic block 42 of FIG. 1, is illustrated in conventional flow chart form. Upon the starting of the logic function the erase through tab logic 42 receives a signal from keyboard 12 through function decode logic 38 and escapement logic 22. The logic 42 determines in block 52 whether the signal received was an erase signal.

The erase through tab logic block 42 then makes a decision as to whether the decoded signals which it has received is an erase signal. If the answer to that decision is "no" then the control exercised by the erase through tab logic 42 routes the signal to other control logic in the escapement logic section 22 of the printer control unit 32 to accomplish other functions.

If the answer to the decision question of "is an erase signal received?" 52 is "yes" then the erase through tab logic 42 causes the escapement logic 22 to access the line memory 34 (see block 54). If the line memory 34 contains a character in the immediately preceding print position, the erase through tab logic 42 then controls 56 a character erase flow or sequence represented by the flow chart in FIG. 5. This will be more fully discussed below.

If the character is not present 56 in the line memory position immediately preceding that representing the print point of the printer, then the code from line memory 34 is interrogated 58 to determine whether a special tab or flag code represented. If that is not a special tab code 58, the flow branches to other portions of the printer control unit 32 for other routines which do not form a portion of this disclosure and do not relate to this invention.

If a special tab or flag code is contained in the immediately preceding memory position, the line memory 34 is again accessed to determine the tabulation start location code value 60 which immediately precedes the special tab or flag code stored in the line memory 34. This location code, stored in the line memory 34, represents the location of the print point at the time that a tabulation command was generated by the special function portion 36 of the keyboard 12. Upon the retrieving from line memory 34 of this location value, a comparison 62 is made through conventional logic procedures of adding one escapement increment to the position retrieved from line memory 34 and comparing that sum with the carrier position to accomplish the determination as to whether the present print point is more than one backspace increment from the position at which the tabulation command was generated. If the two values do compare, then the answer is that the two locations are not more than one character increment apart and the determination results in the "no" answer. Upon that answer, the flow path will branch to the Special Escapement flow routine illustrated at 64 in FIG. 6, and will result in a reverse tabulation of the carrier 13 to the position at which the tabulation command was generated at the keyboard 12 by the special functions portion 36.

Figure 6:
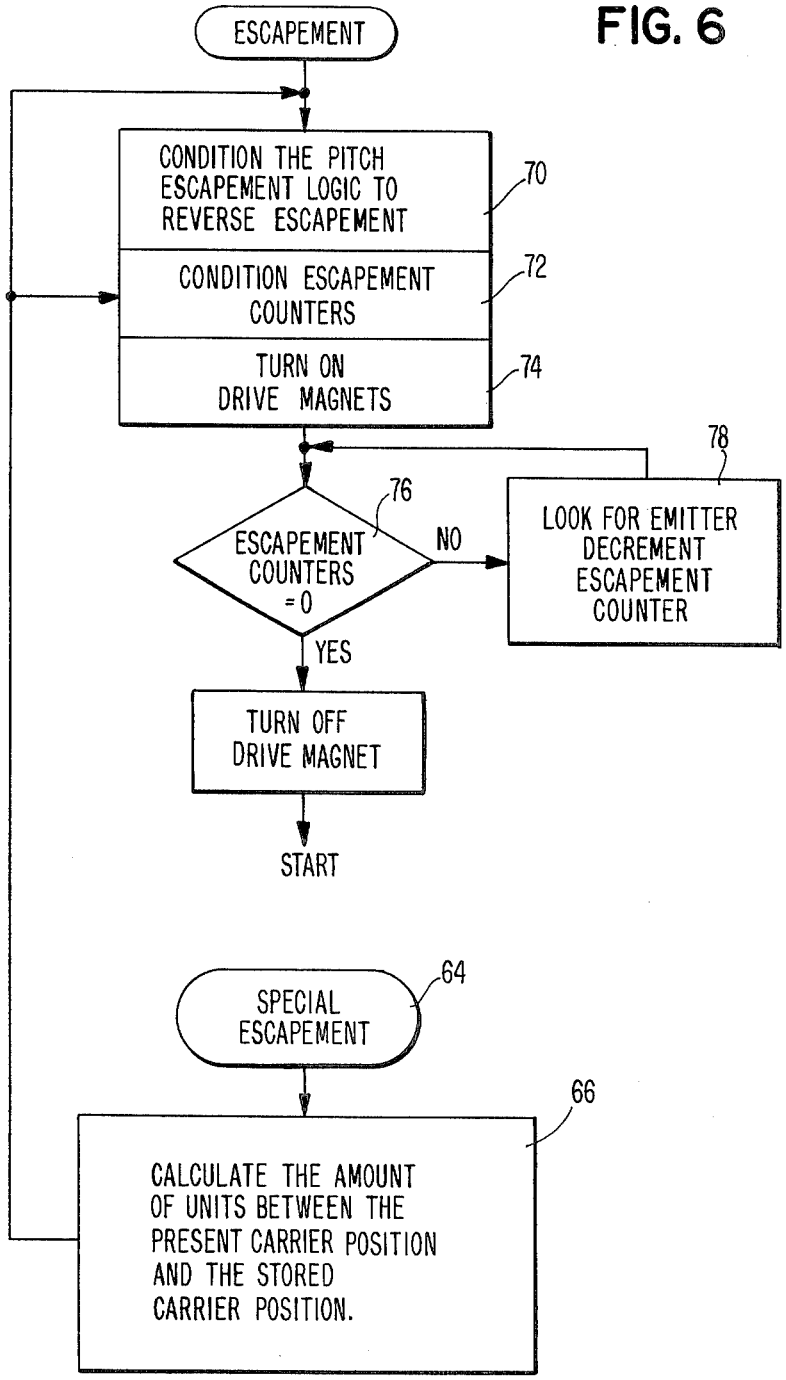

If the two values fail to compare then the answer to the questions of whether the two locations are more than one backspace apart, is "yes" and the flow will branch to the routine which will then in turn condition the escapement logic 22 to effect a backspace, FIG. 6.

Referring now to FIGS. 1 and 6, the escapement flow is controlled under the erase through tab logic 42 to condition the escapement logic 22 of the printer control unit 32 to generate the appropriate signals through the escapement counter 26 to effect a control of the magnet drivers 30 which will in turn control reverse escapement. The conditioning of the escapement logic 22 to effect this reverse escapement 70 is dependent upon the pitch selection feedback which will in turn control the logic 22 to insure that the appropriate number of escapement units are loaded into the escapement counter 26 (block 72) so that the incremental escapement is made in accordance with the pitch selection. Upon the completion of the loading of the escapement counter 26, FIG. 1 the magnet drivers 30 are then turned on 74 by signals emanating from the escapement logic 22 through the escapement counter 26. The reverse direction magnet driver 30 is thus activated, and as the lead screw 19 of the typewriter 10 rotates and the photoemitter/sensor 17 generates feedback pulses indicating rotation of lead screw 19, the escapement counter 26 is decremented. The escapement counter 26 is interrogated on each cycle by the escapement logic 22 to determine whether the escapement counter value is equal to zero 76 indicating that the escapement counter 26 has completed its decrementation in response to the appropriate movement of the print carrier 13. If the escapement counter's value is greater than 0 the escapement counter 26 and thus the escapement logic 22 will continue to look for additional pulses 78 from the photoemitter/sensor 17 and continue to decrement the escapement counter 26. The escapement counter 26 equal to zero 76 comparison will thus continue until the escapement counter value is equal to zero. Upon the determination that the escapement counter value is zero the magnet drivers 30 which were previously turned on to effect the reverse escapement are then turned off.

At this point the flow will return to the start of erase routine in the beginning of FIG. 4. The foregoing description represents the flow of the generalized flow of signals and commands under the control of the erase through tab logic 42 necessary to accomplish a backspace. Returning to FIG. 4, and the "no" decision path emanating from the decision block 62 which has determined that the two positions, that of the location of the print point and that of the location at which the tabulation command was generated are in fact no more than one backspace increment apart and which results in a negative answer causes the branching of the flow to the special escapement flow represented in FIG. 6. Upon the branching, the actual number of escapement units between the two positions are then calculated 66 and the flow then branches back into the escapement routine illustrated in FIG. 6. The value determined in the special escapement calculation described immediately above is then loaded into the escapement counter 26 (block 72) and the appropriate magnet drivers 30 are turned on 74, under the control of the escapement logic 22 and the erase through tab logic 42. The escapement routine is then accomplished as was previously described with respect to the backspace operation and upon the escapement counter 26 equaling 0 the magnet drivers 30 are turned off and the flow returned to the start found in FIG. 3.

Assuming that the erase routine has been performed a sufficient number of times to position the print point over the location at which a tab command had been previously generated, and that the erase signal has been received again, then the line memory 34 is accessed. The condition now being described will result in a character being accessed from the line memory 34 from the immediately preceding storage position. Upon the determination that a character is present, the routine will branch to the character erase sub-routine. The character erase sub-routine is illustrated in the flow diagram of FIG. 5. Upon the branching of the flow of control signals to the character erase routine and dependent upon the pitch which has been selected by the operator, the character code accessed from the line memory 34 is then utilized 80 through the character and velocity decode logic 18 of the printer control unit 32, to determine the number of escapement units necessary to position the print point over the previously printed character. This number of escapement units is then loaded into the escapement counter 26 and the escapement logic 22 conditions the escapement counter 26 (block 82) and the magnet drivers 30 (block 84) so that when the magnet drivers 30 are turned on, reverse escapement is accomplished. The escapement counter 26 is then interrogated to determine if its value is equal to zero 86 in exactly the same manner as described in reference to FIG. 6 and the escapement routine. Upon the determination that the escapement counter 26 is equal to zero, the magnet drivers 30 are turned off 88. Then the character and velocity decode logic 18 is conditioned through the line memory 34 to control the erase magnet driver 30 and the tilt and rotate magnet drivers 20 to accomplish the lifting of the erase tape 7 and the appropriate rotation and tilt of the type element 11 together with the appropriate velocity driver 20 selecting the velocity necessary to impact the previously typed and erroneous character against the correction tape 7 and hence against the page to accomplish the correction of the erroneously typed character. The completion of this function then results in the branching of the flow back to the start routine FIG. 3. Subsequent operations of the typewriter 10 either to erase additional characters by following the above described flow or other routines of the typewriter 10 may then be accomplished. If upon the interrogation of escapement counter 26 its contents are not equal to "0", the routine branches and additional emitter pulses are looked for and upon receipt, the escapement counter 26 is decremented 87.

The embodiment which this invention may take may be in one of several alternative forms. One form described above in conjunction with the block diagrams and flow charts illustrates one embodiment. An alternative embodiment may be an electronic processor control which may operate in conjunction with a permanently configured read only storage or memory equivalent to erase through tab logic 42 in which a series of instructions and/or codes may be stored. This electronic apparatus would correspond to the apparatus as described in conjunction with FIGS. 1 through 6.

In such a case, an alternative to the flow diagrams illustrated in FIGS. 3 through 6 could be to stored codes or commands in the read only storage to cause the electronics to process the information from the keyboard 12 in a particular way and to control the printer in a predetermined sequence of steps. The commands and codes stored in the read only storage may take the form of those attached in Appendix A and Appendix B. Appendix A is a listing of definitions which identify and are associated with particular registers or particular bits within a byte and equates those register designations and/or bit designations with mnemonics.

Figure 7:
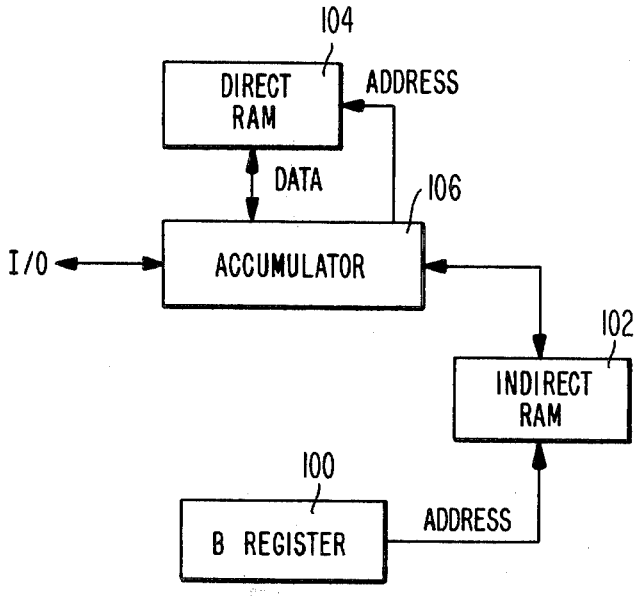
FIG. 7 is a block diagram of an arrangement of memories, a register and an accumulator useful to understand the code and instructions in Appendices A through D.

As an aid to understanding the codes and instructions in Appendices A–D, reference should be made to FIG. 7 which illustrates a register 100, memories 102, 104 and an accumulator 106 and their interconnections.

Appendix B is the complete listing of a set of instructions which serve to control the processor and may be programmed or coded as desired in order to control the electronic processor. Particular embodiments of the code or instructions may be modified as desired by one skilled in the art to accomplish the particular function of the invention. Additionally it should be recognized that a programmable processor may embody a program which may be written conforming to the requirements of that processor for accomplishing the same result.

Referring to Appendix B, Column 1 is the address, in hexadecimal code, where that particular instruction is stored. Column 2 represents the hexadecimal code for the instruction stored in the location designated by the corresponding information in Column 1. Column 3 is the mnemonics identifying the start point of particular sub routines.

Column 4 is the mnemonics for the instruction which the processor then executes. Column 5 contains mnemonics which then, through definitions and equality statements in Appendix A assigns numerical values for registers or bits as appropriate for the instructions contained in Column 4. Column 6 are explanatory comments.

Appendix C includes a listing of the instruction, the mnemonics representing these instructions and two columns designated respectively first byte and second byte having also bit position indicated digitally.

With reference to those bytes illustrated in the two byte columns, these represent how that particular instruction would appear in the read only storage or memory. The ones and zeros in those bytes are dedicated values which remain unchanged for that particular instruction while the B's contained in the instruction code indicates the bits to be tested and the A's are representative of the address to which the instruction series will branch upon the meeting of particular conditions set forth, depending upon whether the bits B are represented by a 1 or 0. Referring to other instructions, the letter D represents a fixed value in memory and is determined by the individual implementing the command.

The R's are representative of the numerical designation for 1 of 32 separate registers which are available for storage of data and which are available to the processor.

Appendix D includes an instruction summary which lists the mnemonic, the name of the instruction represented by the mnemonic and a brief description of the function performed by the processor as a result of that particular instruction.

As an aid to understanding the description of the instructions contained in Appendix D, reference should be made to FIG. 7 which is illustrative of the flow of the instructions between a register 100, memories 102, 104 and accumulator 106. While the invention has been particularly shown and described with reference to preferred embodiment(s) thereof, it will be understood by those skilled in the art that the foregoing and other changes in form and details may be made therein without departing from the spirit and scope of the invention.

APPENDIX A

| | | |
|---|---|---|
| MTARG | EQUALS 0 | SUBADDRESS OF PAST CARRIER POSITION |
| LTARG | EQUALS 9 | ADDRESS OF PAST CARRIER POSITION |
| LCNT | EQUALS 2 | ADDRESS OF PRESENT CARRIER POSITION |
| MINI | EQUALS 3 | SUBADDRESS OF PRESENT CARRIER POSITION |
| MLCNT | EQUALS 4 | MEMORY LINE COUNT. ADDRESS LINE MEMORY |
| KBDBLS | EQUALS 255 | KEYBOARD BAIL STORAGE |
| KBD | EQUALS 5 | KEYBOARD REGISTER |
| PM | EQUALS 9 | PRINTER MAGNET REGISTER, REPRESENTS OUTPUT TO PRINTER |
| REVMAG | EQUALS 1 | REVERSE MAGNET |
| ESCMAG | EQUALS 3 | ESCAPE MAGNET |
| SENSOR | EQUALS 7 | REGISTER THAT CONTAINS INPUT SENSORS |
| EMT | EQUALS 2 | EMITTER REPRESENTS ONE UNIT OF ESCAPEMENT |
| ECNT | EQUALS 6 | UNITS OF ESCAPEMENT REGISTER |
| WK1 | EQUALS 1 | WORKING REGISTER |
| WK2 | EQUALS 10 | WORKING REGISTER |
| WK3 | EQUALS 11 | WORKING REGISTER |
| WK5 | EQUALS 12 | WORKING REGISTER |
| WK6 | EQUALS 13 | WORKING REGISTER |
| ESCTABL | EQUALS 100 | TABLE THAT CONTAINS ESCAPEMENT VALUES OF CHARACTERS |
| VELTABL | EQUALS 200 | TABLE THAT CONTAINS VELOCITY VALUE OF CHARACTERS |
| ERTAPE | EQUALS 3 | ERASE TAPE LIFT MAGNET |
| VELMAG | EQUALS 4 | MAGNET THAT SELECTS VELOCITY OF IMPACT |
| CHARMAG | EQUALS 5 | MAGNET THAT SELECTS CHARACTER |
| B1 | EQUALS 0 | FIRST BAIL FROM KEYBOARD |
| B2 | EQUALS 1 | SECOND BAIL FROM KEYBOARD |
| B3 | EQUALS 2 | THIRD BAIL FROM KEYBOARD |

APPENDIX B

| | | | | | |
|---|---|---|---|---|---|
| 0000 | 87 | START | LR | SENSOR | IS THERE AN INPUT? |
| 0001 | E000 | | TJN | STRB,START | |
| 0003 | ABFF | | LBD | KBDBLS | |
| 0005 | B0 | | LN | 0 | OBTAIN INPUT |
| 0006 | 05 | | STR | KBD | |
| 0007 | C08E | | TJE | B1,CHAR | IS INPUT A CHARACTER |
| 0009 | C48E | | TJE | B2,CHAR | |
| 000B | C88E | | TJE | B3,CHAR | |
| 000D | ABF0 | | LBD | X'F0' | IS INPUT AN ERASE? |
| 000F | 4017 | | CJE | ERASE | |
| 0011 | ABFA | | LBD | X'FA' | IS INPUT A TAB? |
| 0013 | 4093 | | CJE | TAB | |
| 0015 | 2105 | | BR | OTHERS | |
| 0017 | 85 | ERASE | LR | KBD | IS THE KEYBOARD INPUT AN ERASE? |
| 0018 | ABF0 | | LBD | X'F0' | |
| 001A | 401E | | CJE | ER1 | |
| 001C | 2105 | | BR | OTHERS | |
| 001E | 84 | ER1 | LR | MLCNT | BUMP MEMORY |
| 001F | AF | | S1 | | |
| 0020 | 04 | | STR | MLCNT | |
| 0021 | A4 | | LBR | MLCNT | LOAD CHARACTER OUT OF MEMORY |
| 0022 | B0 | | LN | 0 | |
| 0023 | C057 | | TJE | B1,CHERASE | |
| 0025 | C457 | | TJE | B2,CHERASE | |
| 0027 | C857 | | TJE | B3,CHERASE | |
| 0029 | AB8F | | LBD | X'8F' | |
| 002B | 402F | | CJE | ER2 | IS IT A SPECIAL TAB CODE? |
| 002D | 2105 | | BR | OTHERS | |
| 002F | A4 | ER2 | LBR | MLCNT | |
| 0030 | B0 | | LN | 0 | |
| 0031 | 09 | | STR | LTARG | |
| 0032 | 84 | | LR | MLCNT | |
| 0033 | AF | | S1 | | |
| 0034 | 04 | | STR | MLCNT | |
| 0035 | A4 | | LBR | MLCNT | |
| 0036 | B0 | | LN | 0 | |
| 0037 | 00 | | STR | MTARG | |
| 0038 | 89 | | LR | LTARG | HOW CLOSE TO THE TAB POINT ARE WE? |
| 0039 | AE | | A1 | | |
| 003A | A2 | | LBR | LCNT | |
| 003B | 403F | | CJE | SPESC | |
| 003D | 2078 | | BR | ESCAP | |
| 003F | 80 | SPESC | LR | MTARG | FIND THE UNITS OF ESCAPEMENT TO THE TAB |
| 0040 | AE | | A1 | | |
| 0041 | AE | | A1 | | |
| 0042 | AE | | A1 | | |
| 0043 | AE | | A1 | | |
| 0044 | AE | | A1 | | |
| 0045 | 00 | | STR | MTARG | |

APPENDIX B-continued

| | | | | | |
|---|---|---|---|---|---|
| 0046 | 83 | | LR | MINI | |
| 0047 | 01 | | STR | WK1 | |
| 0048 | A0 | SP1 | LBR | X'0' | SUBTRACT MINI FROM MTARG |
| 0049 | 4053 | | CJE | SP2 | |
| 004B | 80 | | LR | MTARG | |
| 004C | AF | | S1 | | |
| 004D | 00 | | STR | MTARG | |
| 004E | 81 | | LR | WK1 | |
| 004F | AF | | S1 | | |
| 0050 | 01 | | STR | WK1 | |
| 0051 | 2048 | | BR | SP1 | |
| 0053 | 80 | SP2 | LR | MTARG | |
| 0054 | 06 | | STR | ECNT | |
| 0055 | 207A | | BR | SP1 | |
| 0057 | A4 | CHERASE | LBR | MLCNT | OBTAIN CHAR. FROM LINE MEMORY |
| 0058 | B0 | | LN | 0 | |
| 0059 | AE | | A1 | | |
| 005A | B0 | | LN | ESCTABL | FIND ESCAPE VALUE |
| 005B | 06 | | STR | ECNT | |
| 005C | 89 | | LR | PM | START MOTION |
| 005D | 69 | | SBS | REVMAG | |
| 005E | 5B | | SBS | ESCMAG | |
| 005F | 86 | | LR | ECNT | |
| 0060 | A0 | CH3 | LBR | X'0' | |
| 0061 | 406B | | CJE | CH1 | |
| 0063 | 87 | CH2 | LR | SENSOR | IS CARRIER THERE YET? |
| 0064 | E863 | | TJN | EMT,CH2 | |
| 0066 | 86 | | LR | ECNT | |
| 0067 | AF | | S1 | | |
| 0068 | 06 | | STR | ECNT | |
| 0069 | 2060 | | BR | CH3 | |
| 006B | 89 | CH1 | LR | PM | STOP CARRIER MOTION |
| 006C | 51 | | RBS | REVMAG | |
| 006D | 53 | | RBS | ESCMAG | |
| 006E | 89 | | LR | PM | LIFT ERASE TAPE |
| 006F | 5B | | SBS | ERTAPE | |
| 0070 | A4 | | LBR | MLCNT | OBTAIN CHARACTER |
| 0071 | B0 | | LN | 0 | |
| 0072 | 05 | | STR | CHARMAG | PRINT CHACTER |
| 0073 | AE | | A1 | | |
| 0074 | B0 | | LN | VELTABL | SET VELOCITY |
| 0075 | 04 | | STR | VELMAG | |
| 0076 | 2000 | | BR | START | |
| 0078 | 74 | ESCAP | LDL | 4 | READY FOR ESCAPEMENT |
| 0079 | 06 | | STR | ECNT | |
| 007A | 89 | E4 | LR | PM | |
| 007B | 59 | | SBS | REVMAG | |
| 007C | 5B | | SBS | ESCMAG | |
| 007D | 86 | | LR | ECNT | |
| 007E | A0 | E1 | LBR | X'0' | |
| 007F | 4089 | | CJE | E3 | |
| 0081 | 87 | E2 | LR | SENSOR | LOOK FOR CARRIER MOVEMENT |
| 0082 | E881 | | TJN | EMT,E2 | |
| 0084 | 86 | | LR | ECNT | |
| 0085 | AF | | S1 | | |
| 0086 | 06 | | STR | ECNT | |
| 0087 | 207E | | BR | E1 | |
| 0089 | 89 | E3 | LR | PM | STOP CARRIER |
| 008A | 51 | | RBS | REVMAG | |
| 008B | 53 | | RBS | ESCMAG | |
| 008C | 2000 | | BR | START | |
| 008E | 85 | CHAR | LR | KBD | PLACE CHARACTER INTO LINE MEMORY |
| 008F | A4 | | LBR | MLCNT | |
| 0090 | A8 | | STN | 0 | |
| 0091 | 2000 | | BR | START | |
| 0093 | 83 | TAB | LR | LCNT | STORE CARRIER POSITION INTO LINE MEMORY |
| 0094 | A4 | | LBR | MLCNT | |
| 0095 | A8 | | STN | 0 | |
| 0096 | 84 | | LR | MLCNT | |
| 0097 | AE | | A1 | | |
| 0098 | 04 | | STR | MLCNT | STORE MINI CARRIER POSITION |
| 0099 | A4 | | LBR | MLCNT | |
| 009A | 83 | | LR | MINI | |
| 009B | A8 | | STN | 0 | |
| 009C | 84 | | LR | MLCNT | |
| 009D | AE | | A1 | | |
| 009E | 04 | | STR | MLCNT | |
| 009F | A4 | | LBR | MLCNT | |
| 00A0 | AA8F | | LDH | X'8F' | STORE SPECIAL TAB CODE |
| 00A2 | A8 | | STN | 0 | |
| 00A3 | 70 | | LDL | 0 | FIND TAB STORAGE TO THE RIGHT, |
| 00A4 | 01 | | STR | WK1 | OF THE PRESENT STORAGE POSITION |

APPENDIX B-continued

| | | | | | |
|---|---|---|---|---|---|
| 00A5 | A1 | TB3 | LBR | WK1 | |
| 00A6 | B0 | | LN | 0 | |
| 00A7 | A2 | | LBR | LCNT | |
| 00A8 | 60AC | | CJL | TB4 | |
| 00AA | 2100 | | BR | TB2 | |
| 00AC | 4100 | TB4 | CJE | TB2 | |
| 00AE | 01 | | STR | WK1 | |
| 00AF | 70 | | LDL | 0 | |
| 00B0 | 0A | | STR | WK2 | |
| 00B1 | B1 | P1 | LR | WK1 | CALCULATE DISTANCE TO TRAVEL BACK |
| 00B2 | AF | | S1 | | |
| 00B3 | 01 | | STR | WK1 | |
| 00B4 | 82 | | LR | LCNT | |
| 00B5 | AF | | S1 | | |
| 00B6 | 02 | | STR | LCNT | |
| 00B7 | AB00 | | LBD | X'0' | WK1 CONTAINS LARGE DISTANCE |
| 00B9 | 40BD | | CJE | P2 | |
| 00BB | 20B1 | | BR | P1 | |
| 00BD | 8A | P2 | LR | WK2 | |
| 00BE | AE | | A1 | | |
| 00BF | AE | | A1 | | |
| 00C0 | AE | | A1 | | |
| 00C1 | AE | | A1 | | |
| 00C2 | AE | | A1 | | |
| 00C3 | 0A | | STR | WK2 | |
| 00C4 | 81 | | LR | WK1 | |
| 00C5 | AF | | S1 | | |
| 00C6 | 01 | | STR | WK1 | |
| 00C7 | 8A | P3 | LR | WK2 | WK2 CONTAINS SHORT DISTANCE |
| 00C8 | AF | | S1 | | |
| 00C9 | 0A | | STR | WK2 | |
| 00CA | 83 | | LR | MINI | |
| 00CB | AF | | S1 | | |
| 00CC | 03 | | STR | MINI | |
| 00CD | AB00 | | LBD | X'0' | |
| 00CF | 40C7 | | CJE | P3 | |
| 00D1 | 81 | P4 | LR | WK1 | SAVE CALCULATED DISTANCE FOR RETURN |
| 00D2 | 0C | | STR | WK5 | |
| 00D3 | 8A | | LR | WK2 | |
| 00D4 | 0D | | STR | WK6 | |
| 00D5 | 89 | | LR | PM | MOVE CARRIER BACKWARD |
| 00D6 | 59 | | SBS | REVMAG | |
| 00D7 | 5B | | SBS | ESCMAG | |
| 00D8 | 87 | P5 | LR | SENSOR | TRAVEL MINI DISTANCE |
| 00D9 | E8D8 | | TJN | EMT, P5 | |
| 00DB | 8A | | LR | WK2 | |
| 00DC | AF | | S1 | | |
| 00DD | 0A | | STR | WK2 | |
| 00DE | AB00 | | LBD | X'O' | |
| 00E0 | 40E4 | | CJE | P6 | |
| 00E2 | 20D8 | | BR | P5 | |
| 00E4 | 75 | P6 | LDL | 5 | |
| 00E5 | 0B | | STR | WK3 | |
| 00E6 | 87 | P7 | LR | SENSOR | TRAVEL MAXI DISTANCE |
| 00E7 | C8E6 | | TJE | EMT, P7 | |
| 00E9 | 8B | | LR | WK3 | |
| 00EA | AF | | S1 | | |
| 00EB | 0B | | STR | WK3 | |
| 00EC | AB00 | | LBD | X'0' | |
| 00EE | 40F2 | | CJE | P8 | |
| 00F0 | 20E6 | | BR | P7 | |
| 00F2 | 81 | P8 | LR | WK1 | |
| 00F3 | AF | | S1 | | |
| 00F4 | 01 | | STR | WK1 | |
| 00F5 | AB00 | | LBD | X'0' | |
| 00F7 | 40FB | | CJE | P9 | |
| 00F9 | 20E4 | | BR | P6 | |
| 00FB | 89 | P9 | LR | PM | |
| 00FC | 51 | | RBS | REVMAG | |
| 00FD | 53 | | RBS | ESCMAG | |
| 00FE | 2000 | | BR | START | |
| 0100 | 81 | TB2 | LR | WK1 | |
| 0101 | AE | | A1 | | |
| 0102 | 01 | | STR | WK1 | |
| 0103 | 20A5 | | BR | TB3 | |
| 0105 | AC | OTHERS | H | | |

APPENDIX C

| INSTRUCTION | MNEUMONIC | FIRST BYTE 8 | 7 | 6 | 5 | 4 | 3 | 2 | 1 | SECOND BYTE 8 | 7 | 6 | 5 | 4 | 3 | 2 | 1 |
|---|---|---|---|---|---|---|---|---|---|---|---|---|---|---|---|---|---|
| TEST BIT - JUMP EQUAL | TJE | 1 | 1 | 0 | B | B | B | A | A | A | A | A | A | A | A | A | A |
| TEST BIT - JUMP NOT EQUAL | TJN | 1 | 1 | 1 | B | B | B | A | A | A | A | A | A | A | A | A | A |
| COMPARE - JUMP EQUAL | CJE | 0 | 1 | 0 | 0 | A | A | A | A | A | A | A | A | A | A | A | A |
| COMPARE - JUMP LESS | CJL | 0 | 1 | 1 | 0 | A | A | A | A | A | A | A | A | A | A | A | A |
| BRANCH | BR | 0 | 0 | A | A | A | A | A | A | A | A | A | A | A | A | A | A |
| LOAD DIRECT LOW | LDL | 0 | 1 | 1 | 1 | D | D | D | D | | | | | | | | |
| LOAD DIRECT HIGH | LDH | 1 | 0 | 1 | 0 | 1 | 0 | 1 | 0 | D | D | D | D | D | D | D | D |
| LOAD REGISTER | LR | 1 | 0 | 0 | R | R | R | R | R | | | | | | | | |
| LOAD INDIRECT | LN | 1 | 0 | 1 | 1 | A | A | A | A | | | | | | | | |
| LOAD B DIRECT | LBD | 1 | 0 | 1 | 0 | 1 | 0 | 1 | 1 | D | D | D | D | D | D | D | D |
| STORE REGISTER | STR | 0 | 0 | 0 | R | R | R | R R | | | | | | | | | |
| STORE INDIRECT | STN | 1 | 0 | 1 | 0 | 1 | 0 | 0 | 0 | | | | | | | | |
| SET BIT AND STORE | SBS | 0 | 1 | 0 | 1 | 1 | B | B | B | | | | | | | | |
| RESET BIT AND STORE | RBS | 0 | 1 | 0 | 1 | 0 | B | B | B | | | | | | | | |
| INCREMENT | A1 | 1 | 0 | 1 | 0 | 1 | 1 | 1 | 0 | | | | | | | | |
| DECREMENT | S1 | 1 | 0 | 1 | 0 | 1 | 1 | 1 | 1 | | | | | | | | |
| NO OPERATION | NOP | 1 | 0 | 1 | 0 | 1 | 1 | 0 | 1 | | | | | | | | |
| EMITTER | ER | 1 | 0 | 1 | 0 | 1 | 0 | 0 | 1 | | | | | | | | |

APPENDIX D

Instruction Summary

| Mnemonic | Name | Description |
|---|---|---|
| TJE B,A | Test Bit - Jump Equal | Test bit B in the accumulator and when on, branch to A. |
| TJN B,A | Test Bit - Jump Unequal | Test bit B in the accumulator and when off branch to A. |
| CJE R,A | Compare - Jump Equal | Compare byte R in B register with accumulator and when equal branch to A. |
| CJL R,A | Compare - Jump Low | Compare accmulator to byte R in B register and when accumulator is less than R branch to A. |
| BR A | Branch | Branch to A. |
| J A | Jump | Jump to A. |
| LDL D | Load Direct Low | Load low half of the accumulator from the instruction. Zero high half. |
| LDH D | Load Direct | Load the accumulator from the instruction. |
| LR R | Load Register | Load accumulator from direct memory. Place direct memory address in storage address Register. |
| LBR R | Load B Register | Load the B Register from direct memory. |
| LN A | Load Indirect | Load the accumulator from indirect memory. (Address given by B Register and 4 bits of the instruction.) |
| STR R | Store Register | Store the accumulator in direct memory. Place direct memory address. |
| STN | Store Indirect | Store the accumulator in indirect memory (Address in Register.) |
| SBS B | Set Bit and Store | Set bit B in direct memory (address in Storage Address Register) to 1. |
| RBS B | Reset Bit and Store | Set bit b in direct memory (address in Storage Address Register) to 0. |
| A1 | Increment | Add one to the accumulator. |
| S1 | Decrement | Subtract one from the accumulator. |
| NOP | No Operation | Go to next instruction. |
| ER | Emitter Reset | Reset Emitter latch. |

We claim:

1. An erase control for a typewriter capable of typing on an image page comprising:

a keyboard, a print means, a print point defining means for defining a print point, backspace means, electronic control means for receiving keyboard data and controlling said print means to print keyboard characters;

memory means for storing data corresponding to data keyed into said typewriter keyboard;

tabulation means capable of forward and reverse tabulation;

print point position control means including means for indicating the relative position said print point occupies on a printing line;

electronic means for receiving tabulation control signals from said keyboard, storing a value in said memory means corresponding to said print point position at the time of the receipt of said tabulation control signal;

error correction means associated with said memory means and said backspace means and said electronic control means to effect backspacing of said print point, reading said memory means to determine data recorded therein in reverse order of entry, and correction of an error by eradicating said error from said page;

means associated with said error correction means for detecting said value in said memory means and comparing said value with the indication generated by said print point position control means; and a second control means to prevent said error correction means from determining said data and operation of said error correction means to eradicate said error, until said print point is relocated over the point said stored value represents.

2. The erase control for a typewriter as defined in claim 1 wherein said second control means further comprises:

escapement control means operative to backspace said print point in response to an error correction operation when said value and said print point location are located more than one print position apart.

3. The erase control of claim 2:

wherein said escapement control means operate to reverse tabulate to a print position corresponding to said value in response to an error correction operation when said print position is displaced one or less print positions to the right of said print position corresponding to said value.

4. The erase control of claim 1 wherein:

said electronic means for receiving tabulation control signals further stores a special tabulation code in said memory means following said value; and said means associated with said error correction means for detecting said value further detects said special tabulation code to operate said backspace means.

5. An erase control for a typewriter capable of typing on an image page comprising:

a keyboard for generating signals, including a tabulation signal, a print means, backspace means, electronic means for receiving signals from said keyboard representing characters and functions and including a tabulation signal and for controlling said print means to print said keyboard characters and perform said functions;

memory means responsive to said electronic control means for storing data corresponding to said characters and functions keyed into said keyboard, escapement means capable of moving said print means in forward and reverse directions along a print line, means for providing an indication of the position of said print means with respect to said print line, tabulation means for moving and controlling tabulation movement of said print means with respect to said print line and for storing in said memory means, an indication of the position, with respect to said print line, of said print means upon receipt of said tabulation control signal, error correction means responsive to keyboard command and said memory means for effecting escapement in reverse of said print means and the eradication of an erroneously printed character, in response to said keyboard control and the signals from said memory means, said error correction means further responsive to said memory means and codes stored therein representing tabulation commands, to backspace said print means and inhibit the printing function of said print means until said print means occupies a position previous to a tabulation command entry position where characters exist as previously typed.

* * * * *